US006030322A

United States Patent [19]

Webber

[11] Patent Number: 6,030,322

[45] **Date of Patent: *Feb. 29, 2000**

[54] EXERCISE APPARATUS WITH MULTI-EXERCISE PRESS STATION

[76] Inventor: Randall T. Webber, 11162 Morning Creek Dr. South, San Diego, Calif. 92128

[ * ] Notice: This patent is subject to a terminal disclaimer.

[21] Appl. No.: 08/859,356

[22] Filed: May 20, 1997

Related U.S. Application Data

[63] Continuation of application No. 08/374,243, Jan. 18, 1995, Pat. No. 5,683,334.

[51] Int. Cl.[7] ..... A63B 21/06

[52] U.S. Cl. ..... 482/100; 482/137

[58] Field of Search ..... 482/100, 130, 482/133, 137, 138

[56] References Cited

U.S. PATENT DOCUMENTS

| | | | |
|---|---|---|---|
| 4,793,608 | 12/1988 | Mahnke et al. . | |
| 4,949,951 | 8/1990 | Deola . | |
| 4,986,538 | 1/1991 | Ish, III . | |
| 5,217,422 | 6/1993 | Domzalski . | |
| 5,370,595 | 12/1994 | Voris et al. | 482/100 |
| 5,387,171 | 2/1995 | Casey et al. | 482/130 |
| 5,409,440 | 4/1995 | Yang | 482/138 |
| 5,417,633 | 5/1995 | Habing | 482/97 |
| 5,605,523 | 2/1997 | Ish, III et al. | 482/99 |

OTHER PUBLICATIONS

"Lever Weight System 15–7950" brochure, Diversified Products, Opelika, Alabama.

"Swivel Grip" brochure.

Weslo Body Focus advertising circular, Mar. 16, 1994.

Weslo Body Focus owner's manual for *Body Focus Body Weight Resistance System*, Model No. WLSY82040, 1996.

*Primary Examiner*—John Mulcahy

*Attorney, Agent, or Firm*—Brown, Martin, Haller & McClain, LLP

[57] ABSTRACT

An exercise apparatus has a support frame and a bench press assembly rotatably mounted on the support frame. The bench press assembly includes a yoke having a central portion pivotally linked to the frame for swinging movement about a first pivot axis, and opposite side portions, a biassing load linked to the yoke for resisting movement about the first axis, and a pair of handle arms each pivotally connected to a respective one of the yoke side portions for independent articulation. Each handle arm has a handle at each end and is connected to the yoke at a location intermediate the ends of the handle arm.

19 Claims, 5 Drawing Sheets

EXERCISE APPARATUS WITH MULTI-EXERCISE PRESS STATION

This is a continuation of application Ser. No. 08/374,243, filed Jan. 18, 1995, now U.S. Pat. No. 5,683,334.

BACKGROUND OF THE INVENTION

The present invention relates generally to exercise apparatus in which multiple exercise stations are provided for operation in opposition to a weight stack or load to exercise different muscles or muscle groups, and is particularly concerned with exercise apparatus having a press station for performing press type exercises for exercising the chest muscles.

Typically, exercise apparatus of this type is known as a weight machine and includes a support frame on which a weight stack is slidably mounted and linked to various exercise stations via a linkage system such as a cable and pulley mechanism so that the user can lift the weights using different muscle groups depending on the exercise station used. Such machines often incorporate a press station at which a user can perform bench press type exercises by pushing outwardly directly away from the chest against the load in the weight stack. Press stations typically comprise a swing frame pivoted to the support frame for movement in opposition to the weight stack, with a pair of handles for gripping by the user and pushing away from the body to move the swing frame. However, this limits the type of press exercises which can be performed.

In U.S. Pat. No. 4,986,538 of Ish III, a multi-exercise press station is described in which a floating swing frame is used to allow decline, incline, chest and shoulder presses to be performed. The U-shaped, floating swing frame has handles at its ends and is pivoted at a floating pivot to a swing link which is in turn pivoted to the support frame. The swing frame is linked to the weight stack for resisting swinging movement of the swing frame.

U.S. Pat. No. 4,949,951 of Deola describes a press-type exercise machine in which a U-shaped member is pivotally connected to the frame in an overhead position and has its lower ends linked to the weight stack. Two bar members are each connected at one end to a respective end of the U-shaped member via a universal joint connection, and each bar has a gripping member at its free end.

SUMMARY OF THE INVENTION

It is an object of the present invention to provide an exercise apparatus having a press station providing multiple exercise functions.

According to the present invention, an exercise apparatus is provided which comprises a support frame, a yoke having a central portion pivotally linked to the support frame for swinging movement about a first pivot axis, and opposite side portions, a biassing load linked to the yoke for resisting movement about the first pivot axis, and a pair of separate swing arms each comprising an elongate member having opposite ends and a handle secured at each end for selective gripping by a user to perform different exercises, each swing arm being pivotally secured to a respective side portion of the yoke at an intermediate position between the opposite ends of the arm for free rotation of the arm relative to the yoke in at least part of a circular path about a second pivot axis.

With this arrangement, a user can perform a variety of press exercises by positioning a selected handle of each swing arm at a selected position in the circular path, and then pressing the handles outwardly in a selected direction so as to swing the yoke about the first pivot axis against the resistance of the load.

In a preferred embodiment of the invention, each swing arm is pivoted to the yoke at a location closer to one end of the arm to separate the arm into a first, longer handle section and a second, shorter handle section. The first handle section may be inclined upwardly relative to the frame to perform incline press exercises, exercising muscles at the upper chest and front of the shoulders, may be oriented substantially horizontally for vertical bench press exercises, exercising the chest, shoulder and tricep muscles, or may be inclined downwardly to perform decline press exercises, exercising the lower chest and tricep muscles. Preferably, a stop is provided between each swing arm and the yoke to prevent rotation of the swing arm beyond a generally upright position in which the shorter handle section is uppermost, whereby the shorter, second handle section may be used for mid-row, pull exercises which exercise the lateral, trapezius and bicep muscles. The first handle section may also be used to exercise the upper abdominal muscles, by positioning the handle ends of the arms above the shoulders and in front of the neck, gripping with the hands, and then curling the body forward towards the knees.

Thus, the press station of this invention allows a variety of different exercises to be performed conveniently at a single station. The handles can be pushed in any direction to exercise different chest muscle and other muscle regions, and can also be used for pulling in a mid-row style exercise.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 4:
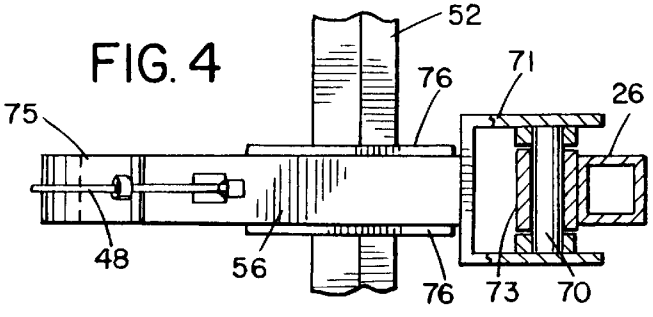
FIG. 4 is an enlarged sectional view taken on line 4–4 of FIG. 1.
Figure 5:
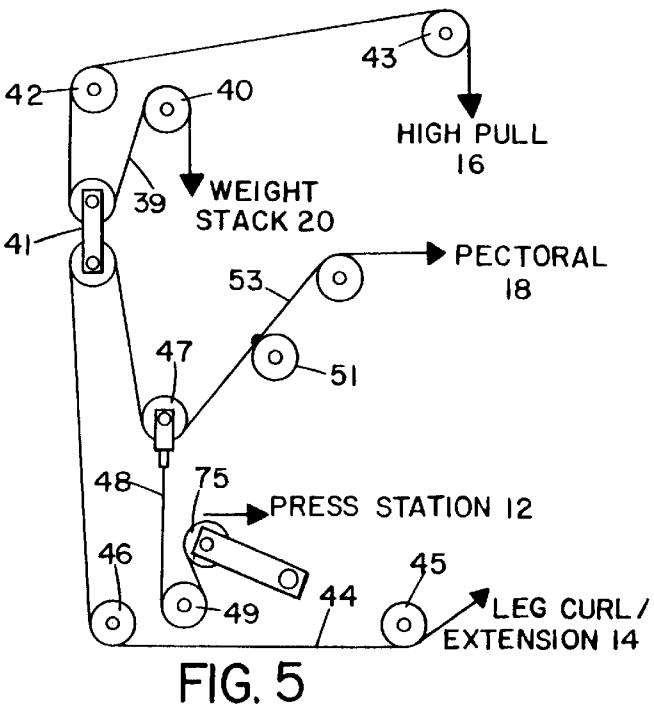
FIG. 5 is a schematic of a cable and pulley system for the exercise machine.

A multi-station exercise apparatus according to a first embodiment of the present invention is illustrated in FIGS. 1–7 of the drawings. The apparatus basically comprises a support frame 10 on which a plurality of exercise stations 12,14 and 16 are mounted and linked to a slidably mounted weight stack 20 via a system of cables and pulleys. The exercise stations include press station 12 which is primarily intended for performing press-type exercises, a leg extension station 14 for performing leg extensions and leg curl exercises, and a high pull station 16 for performing pull-down type exercises. A conventional pectoral station 18 for performing pectoral fly type exercises may also be provided, as schematically illustrated in FIG. 5.

The frame 10 includes base 22, rear upright struts 24 projecting upwardly from the rear end of the base, vertical upright 26 projecting upwardly from an intermediate position on the base, and a top strut 28 projecting transversely across the upper ends of struts 24 and 26. A seat back pad 30 is adjustably mounted on the vertical upright strut 26 via seat adjuster mount 31, and seat bottom pad 32 is adjustably mounted on the base 22 via seat adjuster mount 34. The seat adjuster mount 31 allows the position of pad 30 relative to strut 26 to be adjusted while adjuster mount 34 allows the height of pad 32 to be adjusted. A person sitting on seat pad 32 and resting their back against back pad 30 can perform various exercises using each of the exercise stations, while other exercises can be performed while in a standing position or sitting on pad 32 in a rearward facing position, as will be explained in more detail below.

The weight stack 20 is of standard construction, and comprises a stack of rectangular weights which are slidably mounted on a pair of vertical guide rods 36 extending between the base and top bar of the frame. A conventional adjustment mechanism (not illustrated) is provided for selecting the number of weights in the stack to be lifted. This mechanism includes an adjustment rod extending downwardly through aligned holes in the weights, with each weight having a central horizontal hole registering with a respective hole in the rod. A lock pin is extended through a selected hole into the corresponding hole in the rod to determine how many weights will be lifted. The selected weight and all weights above that weight in the stack will be lifted. The top plate 38 in the stack is linked via a cable and pulley mechanism to the various exercise stations, for example as schematically illustrated in FIG. 5. Although a weight stack is used as the exercise resistance in the illustrated embodiment, it will be understood that other alternative exercise resistance means may be provided in other embodiments of the invention, such as plate loaded devices.

The weight stack is linked via a suitable cable and pulley mechanism including various cables and fixed and floating pulleys to each of the exercise stations, for example as schematically illustrated in FIG. 5. In the illustrated example, a first cable 39 extends from weight stack 20 over top fixed pulley 40 and around the upper pulley of floating double pulley 41, fixed pulleys 42,43 on top strut 28, and out to the high pull station 16. A second cable 44 extends from leg extension station 14 out around lower fixed pulleys 45,46, around the lower pulley of floating double pulley 41, around floating pulley 47, and stops at pulley 51, where it can be attached to another cable 53 for the pectoral station 18, which will be of standard construction, and is therefore not illustrated in detail. Finally, third cable 48 extends from arm press station 12 around fixed pulley 49 and is secured to floating pulley 47. At each exercise station, a stop is provided on the respective cable to prevent pull back when any of the other stations is in use. Thus, exercises performed at the press station 12 will lift the weight stack 20 via cable 48, floating pulley 47, cable 44, double floating pulley 41, and cable 39.

It will be understood that FIG. 5 is only one example of a possible combined cable and pulley linkage from a weight stack to various exercise stations. In addition to the cable and pulley linkages of FIG. 5, for example, cable 44 may extend over pulley 47 and additional pulleys to an AB crunch station as is known in the field, with one of the pulleys being a double floating pulley to link to a pectoral station. Other alternative cable and pulley linkages may be provided, as is known in the field.

Only a single cable and pulley linkage is illustrated in the remaining drawings between the press station 12 and the weight stack 20, with the cable and pulley linkages between the other exercise stations and weight stack being eliminated for clarity. However, it will be understood that, in practice, multiple cable and pulley mechanisms will be provided, for example as schematically illustrated in FIG. 5, in order to link each exercise station to the weight stack and allow each station to be operated independently of the others. Thus, in FIG. 1, only cable 48 is illustrated, extending from the press station over fixed pulley 49 on the base of the frame, and up over top pulley before connecting to top plate 38 of the weight stack.

Figure 2:
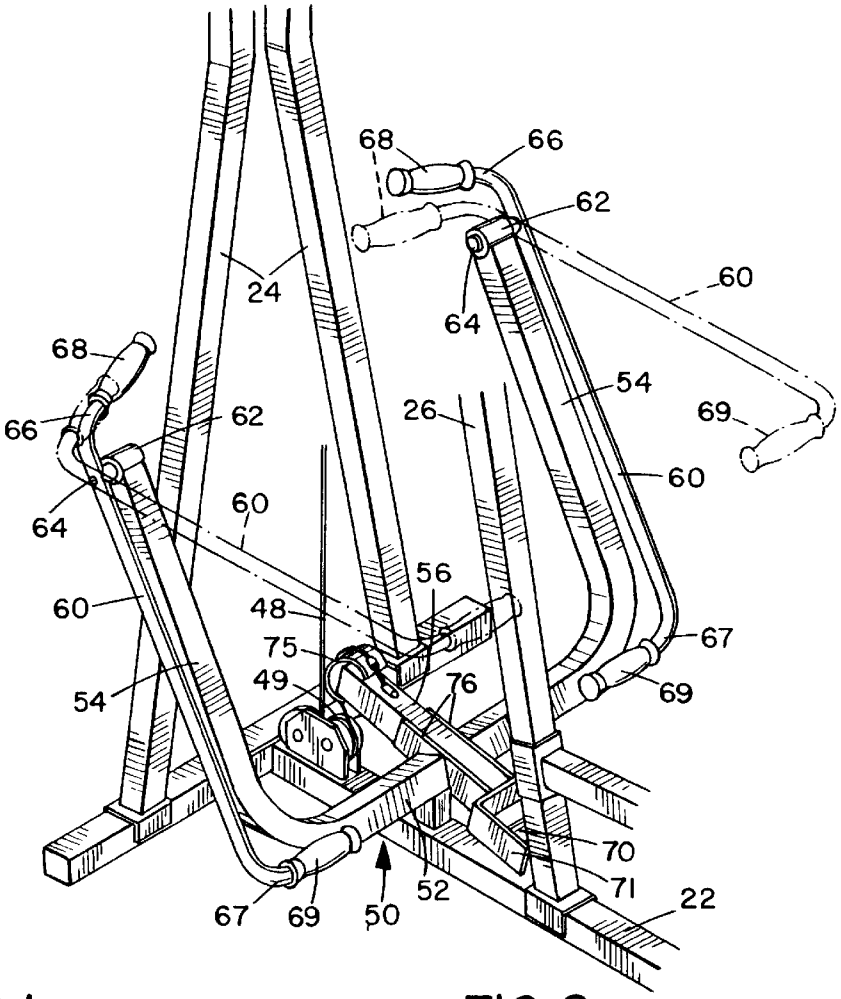
FIG. 2 is an enlarged perspective view of the press arm structure.
Figure 3:
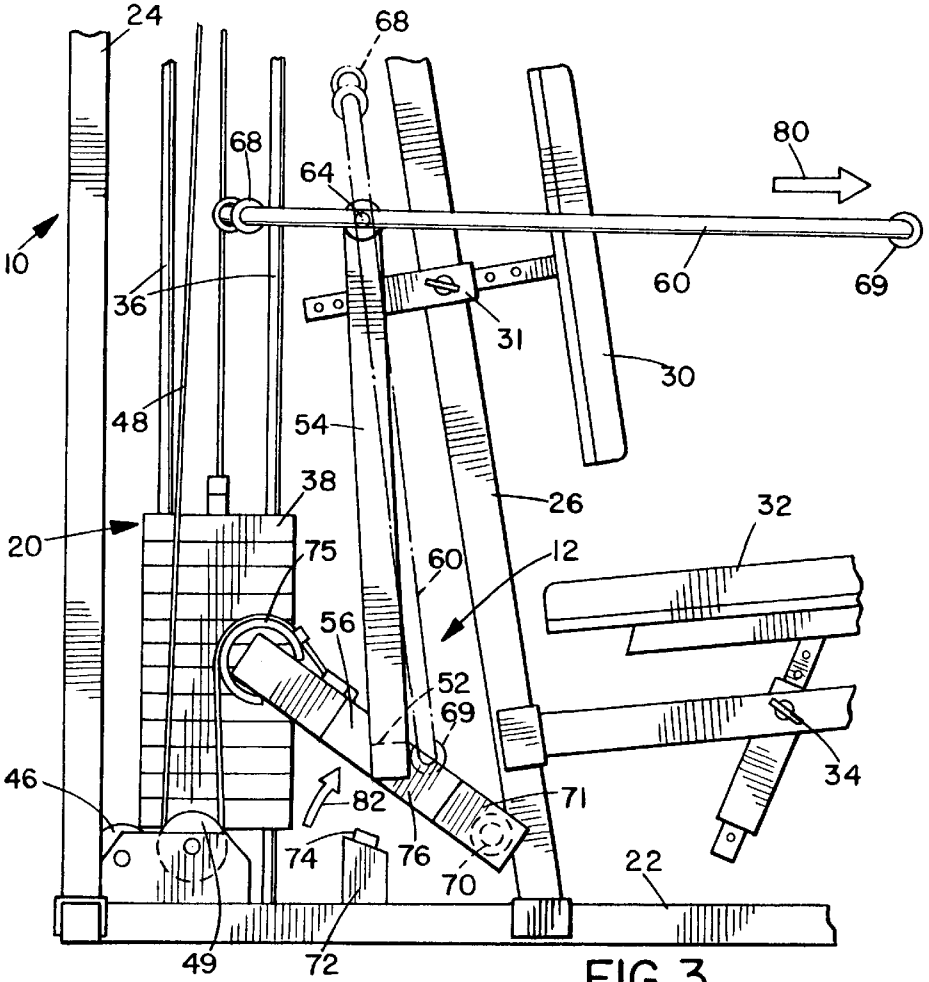
FIG. 3 is an enlarged side elevation view of a lower portion of FIG. 1.

The press station 12 will now be described in more detail with reference to FIGS. 1–4. The station 12 basically comprises a generally U-shaped, split yoke 50 having a central portion 52 and opposite side portions or legs 54, with a lever arm 56 secured to the yoke at an angle to the plane of the yoke, as best illustrated in FIGS. 2 and 3. A pair of swinging handle arms 60 are pivotally secured to the respective ends 62 of the side portions 54 of the yoke via pivot pins 64. Each swing or handle arm 60 has bent portions 66,67 at its opposite ends on which handles or grips 68,69, respectively, are mounted, and is pivotally connected to the respective end 62 of the yoke at a location which is relatively close to handle 68, providing a longer handle arm for handle 69 than handle 68. Each arm 60 is therefore free to pivot about the axis of pivot pin 64 relative to yoke 50. In the rest position illustrated in solid lines in FIGS. 1 and 2, the lower or longer handle arms will pivot downwardly until the inwardly bent handles 69 rest against the central portion 52 of yoke 50, as illustrated in FIG. 2, with the shorter handles 68 uppermost.

The lever arm 56 is pivotally secured at one end to upright strut 26 via press arm pivot shaft 70 at a location adjacent the lower end of the strut, so that the lever arm extends rearwardly from strut 26. As best illustrated in FIG. 4, lever arm 56 has a fork 71 at its end and pivot pin or shaft 70 extends between the opposite limbs of fork 71 and extends rotatably through a mounting tube 73 secured to strut 26. A pulley or cam wheel 75 is secured at the opposite end of the lever arm 56, and the end of press arm cable 48 extends over pulley 75 and is secured to arm 56, as best illustrated in FIGS. 2 and 3. Pulley 75 does not rotate. Alternatively, pulley 75 may be a rotating pulley, and the cable 48 may extend over the pulley and down over another pulley on the frame to extend to other exercise stations. Rest member 72 projects upwardly from base 22 below lever arm 56, and has a rubber bumper 74 at its upper end to provide a rest for lever arm 56 when the press arm station is not in use, as illustrated in FIG. 1.

The yoke is preferably a split yoke made in two halves, each half comprising one of the side legs 54 and half of central portion 52. Each half of yoke 50 has a bracket or end plate 76 at the end of the central portion half. End plate 76 is suitably bolted or otherwise secured to lever arm 56 at a location intermediate the ends of arm 56 and in alignment with the other half of the yoke, as best seen in FIGS. 2 and 4.

Figure 1:
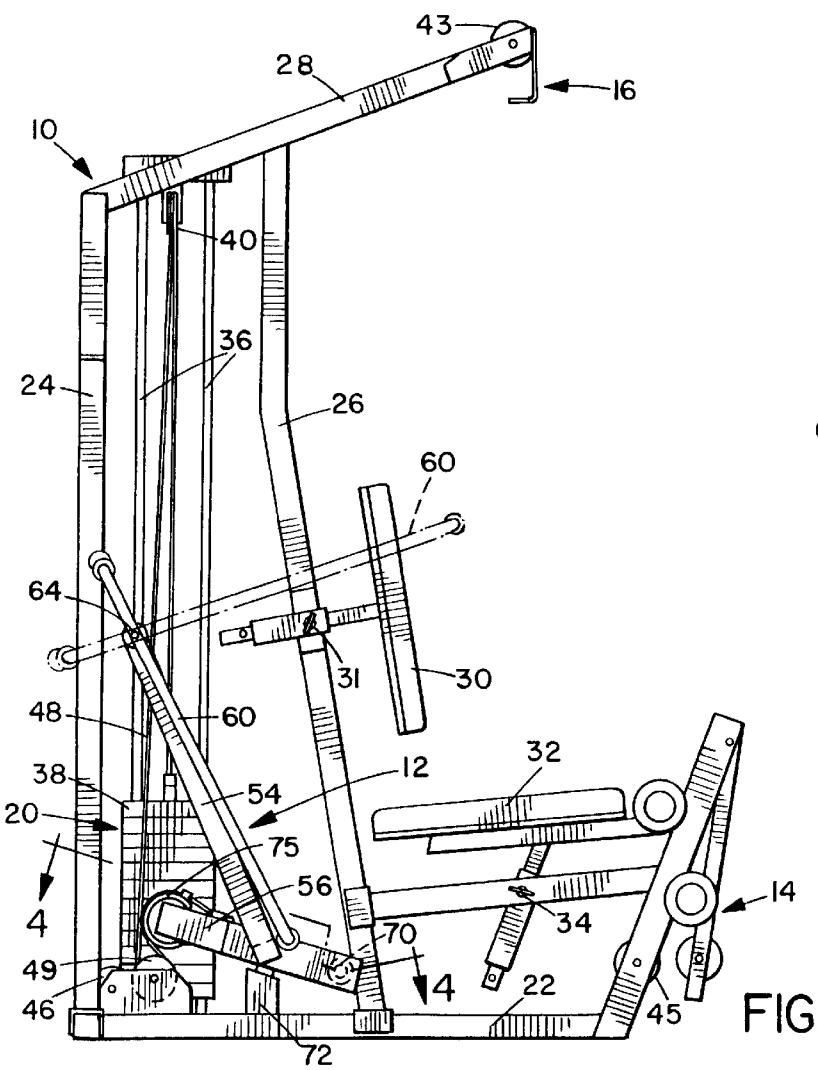
FIG. 1 is a side elevation view of an exercise machine incorporating the press arm assembly according to a preferred embodiment of the invention.

With this arrangement, the handle arms 60 can be freely rotated from the rest position of FIG. 1 about pivot pins 64 to any desired orientation, for example as illustrated in dotted outline in FIGS. 1 and 2. Various types of exercises can then be performed by the user pushing or pulling the handles so as to urge the yoke to rotate about pivot shaft 70 against the load on press arm cable 48. Thus, for example, handle arms 60 may be swung up from the rest position illustrated in dotted outline to the substantially horizontal position illustrated in solid lines in FIG. 3. A user can then perform a vertical bench press type exercise by gripping hand grips or handles 69 and pushing away from seat back 30, in the direction of arrow 80. This acts to pull the yoke 50 forwardly and pivot the lever arm 56 about pivot shaft 70, in the direction of the arrow 82 in FIG. 3, simultaneously pulling on cable 48 and thus lifting the weight stack 20 upwardly as indicated in FIG. 3. The user can adjust the position of handles 69 simply by rotating about pivot pin 64, so that they are at just below shoulder height to perform this exercise, and the same exercise can therefore be performed easily by different height individuals when sitting on seat 32 with their back against back rest 30. This will exercise the chest, shoulder and tricep muscles.

Figure 6:
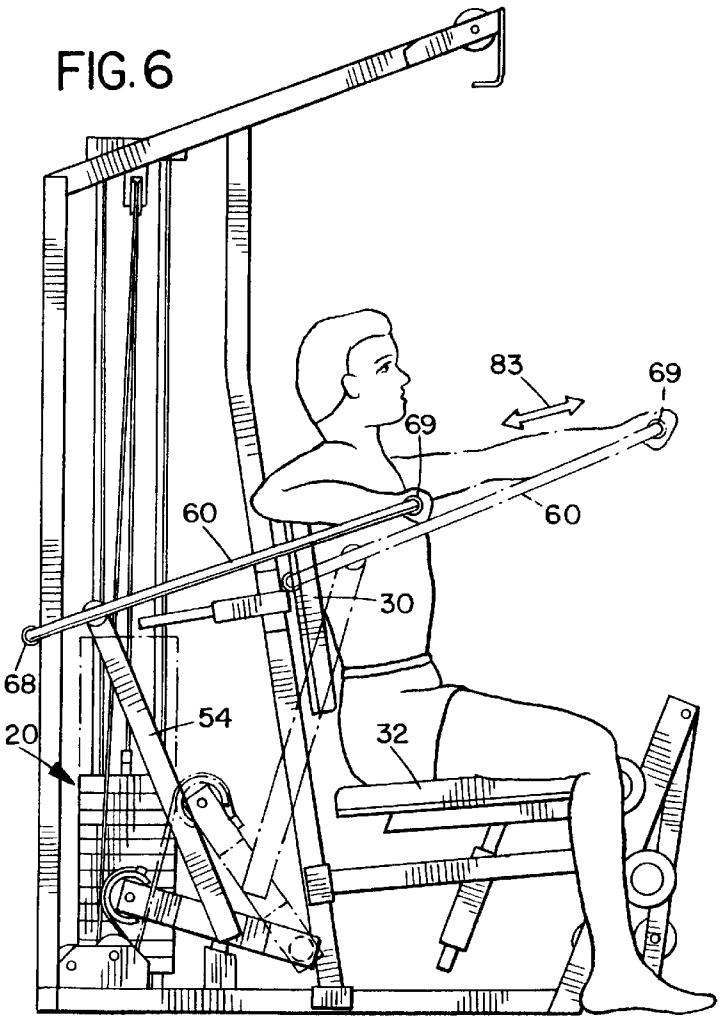
FIG. 6 is a side elevation view of the machine showing one type of exercise using the press arm assembly.

A decline press exercise can be performed by a user in the same position by pressing the handles forward and down. This exercises the lower chest and triceps. Similarly, an incline press exercise can be performed in the identical position by pressing the handles forwardly and upwardly, in the direction of arrow 83 as illustrated in FIG. 6, exercising the upper chest and front of the shoulders. An abdominal crunch exercise can also be performed by a user in the sitting position of FIG. 6 raising the handles 69 to a position above the shoulders and just in front of the neck, and then curling their body forward towards their knees, again rotating the yoke and lever arm about pivot 70 and pulling the cable 48 and attached weight stack elements. This motion will exercise the abdominal muscles.

Figure 7:
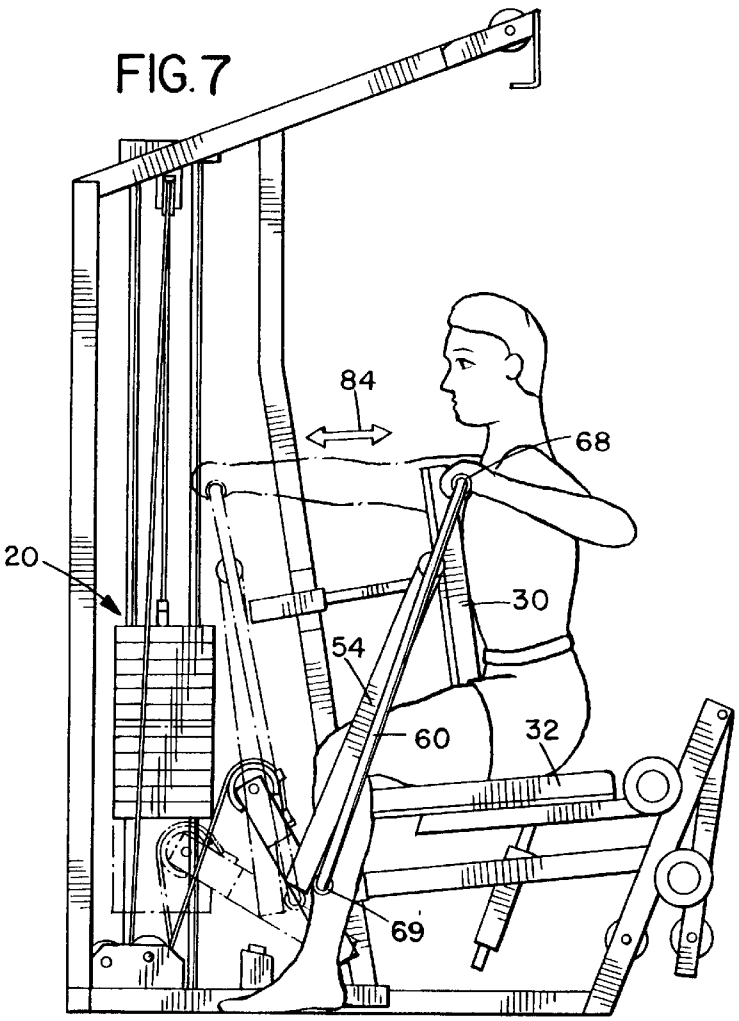
FIG. 7 is a similar view showing another type of exercise.

Another type of exercise may be performed using the short handles 68 with the user seated astride seat pad 32 in a rearward facing position facing the back of the machine and with their chest against back pad 30, as illustrated in FIG. 7. The handle arms are rotated into the rest position in which short handles 68 are uppermost with the in-turned handles 69 at the opposite end of each handle arm bearing against the central portion 52 of the yoke, as best illustrated in FIG. 2. The user then pulls the handles 68 alternately towards and away from their body, as indicated by arrow 84 in FIG. 7. Since the arms cannot rotate due to handles 69 bearing against yoke 50, this has the effect of pulling the yoke and attached lever arm upwardly and forwardly, rotating around pivot shaft 70 as illustrated in FIG. 7. This also pulls on cable 40 and raises the attached weight stack elements. This procedure will exercise the lateral, trapezius and bicep muscles.

Figure 8:
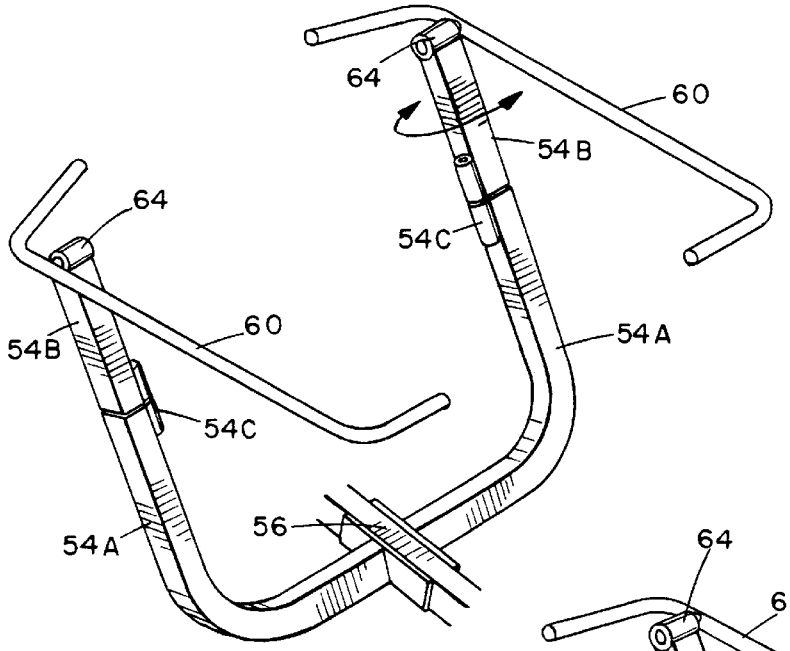
FIG. 8 is a perspective view of part of a modified press arm assembly for the exercise machine of FIG. 1.
Figure 9:
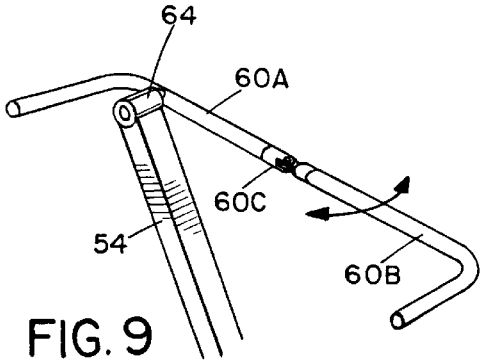
FIG. 9 is a partial view similar to FIG. 8 of one arm of a press arm assembly illustrating another modification.
Figure 10:
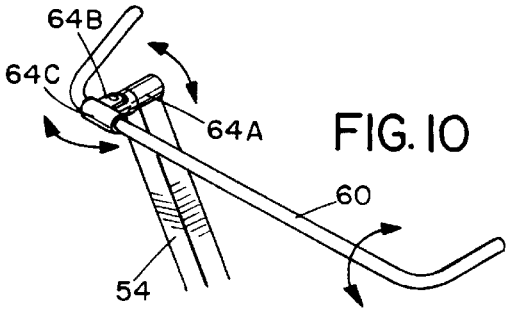
FIG. 10 is a view similar to FIG. 9 illustrating part of the arm of another modified press arm assembly.

FIGS. 8–10 illustrate three alternative arrangements in which the handle arms 60 can be rotated out and in as well as up and down, to provide greater versatility in positioning the handles for a desired exercise. In each case, the remainder of the press arm assembly will be identical to that of the first embodiment, and like reference numerals have been used for like parts as appropriate.

In the embodiment of FIG. 8, the side portions or legs 54 of yoke 50 are each split into two separate portions, an inner portion 54A integral with the central portion of the yoke, and an outer end portion 54B. The portions 54A and 54B on each side of the yoke are secured together via hinge or pivot pin 54C so that the outer end portion 54B can rotate about the axis of the respective leg in the direction of the arrow in FIG. 8. This permits the handle arms 60 to move in an outward to inward motion during exercise, in addition to rotating up and down about pivot or hinge 64.

FIG. 9 illustrates an alternative arrangement in which each handle arm is split into two portions 60A and 60B joined together at elbow joint or pivot 60C to permit inward and outward motion of the handle arm portion 60B in the direction of the arrow in FIG. 9. Again, this will allow handle portion 60B to move in an outward to inward motion during exercise.

FIG. 10 illustrates another alternative arrangement for permitting outward to inward motion as well as up and down motion of the handle arms and swivelling of the handle arm 60 about its own axis to vary the handle orientation. In this alternative, single pivot pin 64 is replaced with a first pivot pin 64A for permitting rotation about a first axis and a second pivot pin 64B perpendicular to the first pin for permitting rotation about a second, perpendicular axis. Pivot pin 64A is rotatably mounted in a sleeve at the end of yoke leg 54. Pivot pin 64B is secured to a sleeve 64C in which handle arm 60 is rotatably mounted, and extends through a transverse bore in pin 64A to provide an articulating joint. This permits the user to rotate arm 60 in sleeve 64C, to pivot the arm up and down about the axis of pin 64A, as well as out and in about the axis of pin 64B, essentially allowing the user to move the arm in all directions.

In each of the above three embodiments, the user has greater freedom of movement than in the first embodiment since they are able to move the handles outwardly and inwardly, and can move the handles up and down in any of the adjusted positions.

Figure 12:
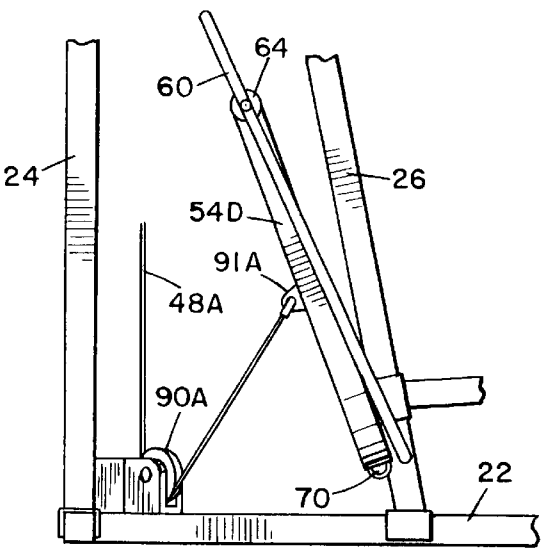
FIG. 12 is a side elevation view of the press arm assembly of FIG. 11.
Figure 11:
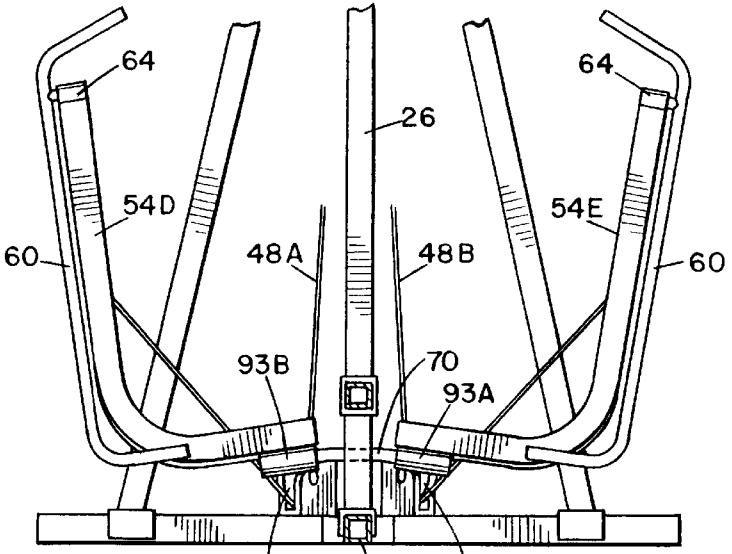
FIG. 11 is a front view of a press arm assembly according to another embodiment of the invention.

In each of the above embodiments, a lever arm 56 is used to transmit load via yoke 54 to the handle arms. FIGS. 11 and 12 illustrate an alternative embodiment in which yoke 54 is replaced with two separate, independently movable yoke arms 54D and 54E. In this alternative, load is transmitted directly to the yoke arms 54D and 54E and the lever arm 56 is eliminated. In this alternative, instead of tying one end of cable 48 to floating single pulley 47 as in the first embodiment, the pulley 47 is replaced with a double pulley and cable 48 extends over the lowermost pulley to provide two end portions 48A and 48B which are secured to the left hand yoke arm 54D and the right hand yoke arm 54E, respectively. Cable end portion 48A extends downwardly from the floating double pulley (not illustrated) and around fixed, outwardly directed pulley 90A, and then outwardly to the yoke arm 54D. The end of cable portion 48A is tied to an eyelet 91A secured to a central portion of the yoke arm 54D. Similarly, cable portion 48B extends downwardly around a second fixed, outwardly directed pulley 90B and is tied to an eyelet (not visible in the drawings) identical to eyelet 91A and secured to an equivalent, central portion of yoke arm 54E.

An angled pivot shaft 70 is secured across strut 26. A sleeve 93A secured to the end of yoke arm 54E is pivotally mounted on one end of pivot shaft 70, as illustrated in FIG. 11. Similarly, a sleeve 93B is secured to the inner end of yoke arm 54D and is pivotally mounted on the opposite end of pivot shaft 70. The angling of the opposite ends of pivot shaft 70 acts to angle the yoke arms outwardly, as illustrated in FIG. 11. As in the first embodiment, handle arms 60 are pivoted to the ends of the respective yoke arms via pivots 64. This arrangement permits the handle or pressing arms 60 to pivot in an outward to inward fashion.

The exercise machine of FIGS. 11 and 12 is otherwise identical to that of the first embodiment, and like reference numerals have been used for like parts as appropriate. Elimination of lever arm 56 simplifies the construction, while the same versatility of exercise movements is provided. The angling of the yoke arms allows outward to inward movement of the handle arms. In press arm type exercises, a movement from a wide starting position to a narrow finish position is believed to be most effective in exercising the muscles, since it provides more muscle closure. The bent pivot shaft of this embodiment permits this type of motion in a simplified fashion.

Figure 14:
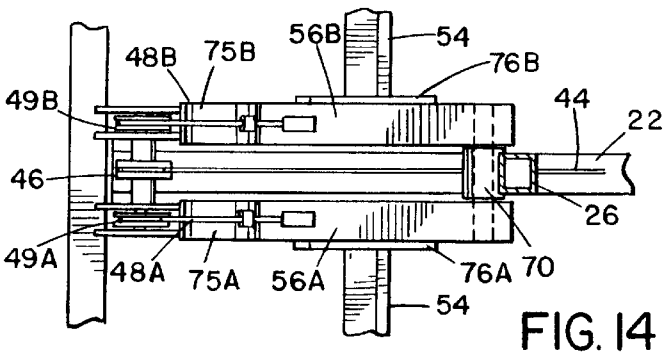
FIG. 14 is a top plan view, partially in section, of the assembly of FIG. 13.
Figure 13:
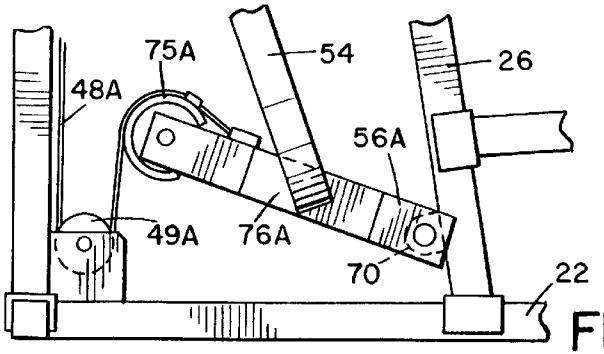
FIG. 13 is a partial side elevation view of another modified press arm assembly.

FIGS. 13 and 14 illustrate another modified embodiment of the invention in which the single lever arm 56 is replaced with separate lever arms 56A and 56B, one for each handle arm 60, to provide separate resistance to motion on each arm. Each lever arm 56A and 56B is independently pivoted at one end to opposite ends of pivot shaft 70, as best illustrated in FIG. 14. A pulley or cam wheel 75A,75B, is secured to the opposite end of each lever arm 56A,56B, respectively. As in the previous embodiment, the cable 48 is split into two end portions 48A and 48B. One end portion 48A extends downwardly over pulley 49A mounted on the base frame and is then secured over cam wheel 75A to the lever arm 56A. Similarly, the other end portion 48B of the cable extends over a pulley 49B and is then secured to the lever arm 56B over cam wheel 75B. The yoke ends 54 are secured to an intermediate point on each of the lever arms via mounting plates 76A and 76B, respectively. The machine of FIGS. 13 and 14 is otherwise identical to the first embodiment, and like reference numerals have been used for like parts as appropriate.

With this arrangement, each handle or pressing arm has its own lever arm and cable attachment, and both lever arms pivot on the same pivot axis for independent resistance.

Figure 15:
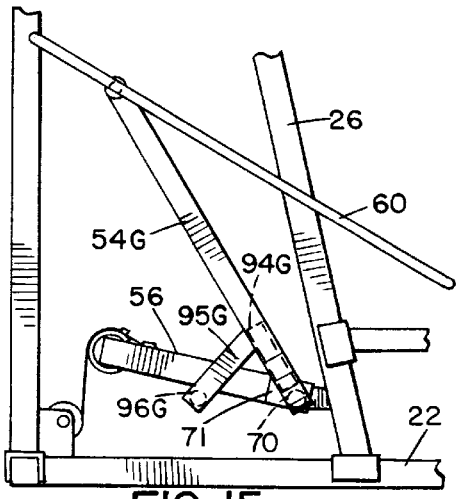
FIG. 15 is a side elevation view of a further modified press arm assembly.
Figure 16:
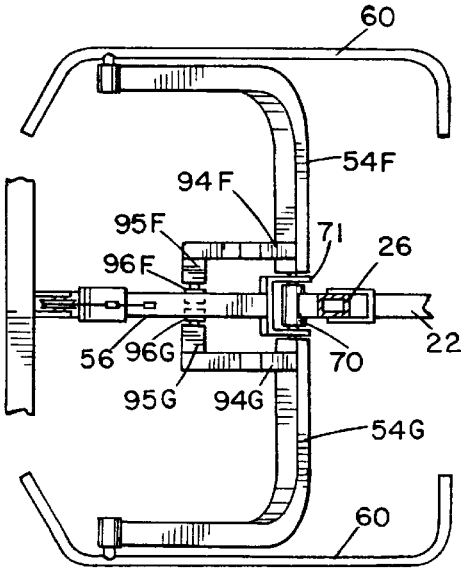
FIG. 16 is a top plan view of the assembly of FIG. 15.

FIGS. 15 and 16 illustrate another alternative arrangement. In this arrangement, instead of rigidly securing the yoke legs to the lever arm, the yoke is split into separate yoke halves 54F and 54G, each of which is pivotally mounted on the support frame via pivot axle 70. Alternatively, the two yoke halves may be mounted on a different pivot axis to arm 56. A link arm 94F,94G projects from each yoke half at a location adjacent lever arm 56. Each link arm has an inwardly and downwardly projecting end portion 95F,95G respectively, carrying a roller 96F,96G projecting beneath the lever arm, so that the lever arm is lifted via either or both yoke halves to provide resistance.

The press station is therefore extremely versatile, and allows the user to freely position the handle to accommodate different height individuals, and, once positioned, to push the handle in any direction to exercise different muscle regions. The low hinge pressing assembly, with independent, circulating arms, allows different exercises to be performed simply by changing the angle of exercise motion. By providing handles at opposite ends of each handle arm and pivoting the arm to the yoke between the handles, the same handle arm can be used both for press exercises and mid-row exercises, simply by reversing the handles. In the past, separate handle arms have been provided for rear-facing, mid-row exercises.

The other three exercise stations linked to the weight stack are of a conventional nature and will therefore not be described in detail.

Although a preferred embodiment of the invention has been described above by way of example only, it will be understood by those skilled in the field that modifications may be made to the disclosed embodiment without departing from the scope of the invention, which is defined by the appended claims.

I claim:

1. An exercise apparatus, comprising:

a support frame;

a yoke assembly comprising a central, elongate, straight yoke portion having spaced, opposite ends, and parallel first and second yoke arms projecting from the respective opposite ends of said central, straight portion, said central yoke portion being pivoted to said support frame at its center for swinging movement in a first path about a first axis;

biasing means linked to said yoke assembly for resisting movement of said yoke arms about said first axis;

a pair of separate swing arms, each swing arm comprising an elongate member having at least one handle at one end for selective gripping by a user to perform selected press exercises, each swing arm being pivotally secured to a respective yoke arm for free rotation of said swing arm around at least part of a circular path about a second pivot axis;

whereby a user can perform selected press exercises by gripping the handle of each swing arm, moving said handle to a selected position in said circular path, and pressing said handles in a press direction to swing said yoke arms about said first axis against the resistance of said biasing means;

said support frame having an upper end, a lower end, a front end and a rear end, and including a seat portion for supporting a user in a first seated position facing the front end of the frame for performing press-type exercises and in a second seated position facing the rear end of the frame for performing pull-type exercises, the central yoke portion being pivotally connected to the frame at a location spaced rearwardly from the seat portion and below the seat portion, and the yoke arms being spaced apart by a distance greater than the width of the seat portion whereby said swing arms can project forwardly on opposite sides of said seat portion for gripping by a user in said first seated position to perform press-type exercises; and the support frame comprising a base, an upright member projecting upwardly from the base, and an upper member at the top of said upright member, the seat portion being spaced forwardly of said upright member, and the central yoke portion being pivoted to the upright member at a location rearward of said upright member.

2. The apparatus as claimed in claim 1, wherein each swing arm is pivotally secured to said respective yoke arm at a position closer to one end of said swing arm than the opposite end.

3. The apparatus as claimed in claim 1, wherein each swing arm has a bent portion at said end comprising said handle.

4. The apparatus as claimed in claim 1, wherein said biassing means comprises a weight stack slidably mounted on said frame and a cable and pulley linkage linking said weight stack to said yoke assembly, the linkage including a single cable linked to the central portion of said yoke assembly.

5. The apparatus as claimed in claim 1, wherein each of the swing arms is pivotable about an additional pivot axis perpendicular to said second pivot axis.

6. The apparatus as claimed in claim 5, wherein each yoke arm comprises separate first and second end portions and a pivotal connection between said first and second end portions, each swing arm being pivotally secured to the second end portion of the respective yoke arm, and each pivotal connection permitting rotation of the respective second end portion and swing arm about said second pivot axis.

7. The exercise apparatus as claimed in claim 1, wherein each swing arm has a length greater than the length of the respective yoke arm.

8. An exercise apparatus, comprising:

a support frame;

a yoke assembly having separate first and second yoke side arms lying in a single yoke plane;

a straight lever arm having opposite side faces and opposite first and second ends, the yoke side arms being connected to respective opposite side faces of said lever arm at a location between said first and second ends, such that the lever arm extends at an angle to said yoke plane, and the first end of said lever arm being pivoted to said support frame for rotation about a first axis;

biassing means linked to the second end of said lever arm for resisting movement of said yoke arms about said first axis;

a pair of separate swing arms, each swing arm comprising an elongate member having at least one handle at one end for gripping by a user to perform selected press exercises, each swing arm being pivotally secured to a respective yoke arm for free rotation of said swing arm around at least part of a circular path about a second pivot axis;

whereby a user can perform selected press exercises by gripping the handle of each swing arm, moving said handle to a selected position in said circular path, and pressing said handles in a press direction to swing said yoke arms about said first axis against the resistance of said biassing means; and each of the swing arms being pivotable about a third pivot axis perpendicular to said second pivot axis.

9. The apparatus as claimed in claim 8, wherein said support frame comprises a base, an upright member projecting upwardly from said base, an upper member at the upper end of said upright member, a seat portion positioned forwardly from said upright member for supporting a user in a first seated position facing a forward end of said frame for performing press-type exercises and a second seated position facing a rear end of the frame for performing pull-type exercises, said lever arm being pivoted to said upright member, and said first and second pivot axes are parallel, horizontal axes.

10. The apparatus as claimed in claim 8, wherein said lever arm is pivotally secured to said upright member adjacent the base of said frame and said lever arm extends rearwardly from said upright member.

11. The apparatus as claimed in claim 8, wherein each swing arm comprises separate first and second end portions, the first end portion of each swing arm being pivotally connected to the respective yoke arm, and each swing arm having a pivot joint between said first and second end portions for allowing said second end portion to rotate about a third pivot axis perpendicular to said first pivot axis.

12. The apparatus as claimed in claim 8, including a pivot joint pivotally securing each swing arm to the respective yoke arm, the pivot joint having first pivot means for rotation of said swing arm about said second pivot axis and second pivot means for rotation of said swing arm about said third pivot axis.

13. An exercise apparatus, comprising:

a support frame;

a yoke having a central portion and opposite side portions, the yoke defining a first plane;

pivot means for pivotally connecting the yoke to the support frame for swinging movement in a first path about a first axis;

biassing means for resisting movement of said yoke about said first axis, the biassing means including an exercise resistance and a linkage between said exercise resistance and said yoke, the linkage including a single, load-bearing cable linked to the central portion of said yoke;

a pair of separate swing arms, each swing arm comprising an elongate member having opposite ends and at least one handle at one of said ends for selective gripping by a user to perform selected press exercises, each swing arm being pivotally secured to a respective side portion of said yoke for free rotation of said swing arm around at least part of a circular path about a second pivot axis;

whereby a user can perform selected press exercises by gripping the handle of each swing arm, moving said handle to a selected position in said circular path, and pressing said handles in a press direction to swing said yoke arms about said first axis against the resistance of said biassing means; and said pivot means comprising a straight lever arm having a central longitudinal axis and opposite first and second ends, the first end being pivotally secured to said support frame and defining said first pivot axis, said second end being linked to said load-bearing cable at a central location aligned with said central longitudinal axis of said lever arm, said lever arm being connected to the central portion of said yoke at a location between said first and second ends, and extending at an angle to said first plane.

14. The apparatus as claimed in claim 13,, wherein a cam wheel is secured to the second end of said lever arm in a plane aligned with the central axis of said lever arm, and said load-bearing cable extends around said cam wheel.

15. The apparatus as claimed in claim 13, wherein a pulley is rotatably mounted on said second end of said lever arm, said load-bearing cable extending around said pulley.

16. An exercise apparatus, comprising:

a support frame;

first and second yoke side arms;

a straight lever arm having opposite side faces and opposite first and second ends, the yoke side arms being connected to respective opposite side faces of said lever arm at a location between said first and second ends, the lever arm extending at an angle to said yoke side arms, and the first end of said lever arm being pivoted to said support frame for rotation about a first axis;

biassing means linked to the second end of said lever arm for resisting movement of said yoke arms about said first axis;

a pair of separate swing arms, each swing arm comprising an elongate member having at least one handle at one end for gripping by a user to perform selected press exercises, each swing arm being pivotally secured to a respective yoke arm for free rotation of said swing arm around at least part of a circular path about a second pivot axis;

whereby a user can perform selected press exercises by gripping the handle of each swing arm, moving said handle to a selected position in said circular path, and pressing said handles in a press direction to swing said yoke arms about said first axis against the resistance of said biassing means; and each swing arm comprising separate first and second end portions, the first end portion of each swing arm being pivotally connected to the respective yoke arm, and each swing arm having a pivot joint between said first and second end portions for allowing said second end portion to rotate about a third pivot axis perpendicular to said first pivot axis.

17. An exercise apparatus, comprising:

a support frame;

a yoke assembly having first and second yoke side arms pivoted to said support frame for rotation about a first axis;

biassing means linked to said yoke assembly for resisting movement of said yoke arms about said first axis;

a pair of separate swing arms, each swing arm comprising an elongate member having at least one handle at one end for gripping by a user to perform selected press exercises, each swing arm being pivotally secured to a respective yoke arm for free rotation of said swing arm around at least part of a circular path about a second pivot axis;

whereby a user can perform selected press exercises by gripping the handle of each swing arm, moving said handle to a selected position in said circular path, and pressing said handles in a press direction to swing said yoke arms about said first axis against the resistance of said biassing means; and a pivot joint pivotally securing each swing arm to the respective yoke arm, the pivot joint having first pivot means for rotation of said swing arm about said second pivot axis, second pivot means for rotation of said swing arm about a third pivot axis perpendicular to said second pivot axis, and a third pivot means for rotation of said swing arm about a fourth axis which is coaxial with the longitudinal axis of said swing arm.

18. An exercise apparatus comprising:

a support frame;

a yoke having a central portion and opposite side portions;

pivot means for pivotally connecting the yoke to the support frame for swinging movement in a first path about a first axis;

biasing means for resisting movement of said yoke about said first axis, the biasing means including an exercise resistance and a linkage between said exercise resistance and said yoke, the linkage including a single, load-bearing cable linked to the central portion of said yoke;

a pair of separate swing arms, each swing arm comprising an elongate member having opposite ends and at least one handle at one of said ends for selective gripping by a user to perform selected press exercises, each swing arm being pivotally secured to a respective side portion of said yoke for free rotation of said swing arm around at least part of a circular path about a second pivot axis, whereby a user can perform selected press exercises by gripping the handle of each swing arm, moving the handle to a selected position in said circular path, and pressing said handles in a press direction to swing said yoke arms about said first axis against the resistance of said biassing means;

said pivot means comprising a lever arm having a central longitudinal axis and opposite first and second ends, the first end being pivotally secured to said support frame and defining said first pivot axis, said second end being linked to said load-bearing cable at a central location aligned with said central longitudinal axis of said lever arm, said lever arm being connected to the central portion of said yoke at a location between said first and second ends;

a cam wheel secured to the second end of said lever arm in a plane aligned with the central axis of said lever arm, said load-bearing cable extending around said cam wheel; and the cam wheel being non-rotatable.

19. An exercise apparatus, comprising:

a support frame;

a yoke assembly having a central portion and first and second yoke arms projecting from opposite ends of said central portion, said yoke assembly lying in a first plane;

a central lever arm having a first end pivoted to said support frame for swinging movement in a first path about a first axis, and a second end;

said lever arm being secured to said central portion of said yoke assembly at a location between said first and second ends to extend at an angle to said first plane;

biassing means linked to said second end of said lever arm in alignment with the central axis of said lever arm for applying a central pull to said yoke assembly for resisting movement of said yoke arms about said first axis;

a pair of separate swing arms, each swing arm comprising an elongate member having at least one handle at one end for selective gripping by a user to perform selected press exercises, each swing arm being pivotally secured to a respective yoke arm for free rotation of said swing arm around at least part of a circular path about a second pivot axis;

whereby a user can perform selected press exercises by gripping the handle of each swing arm, moving said handle to a selected position in said circular path, and pressing said handles in a press direction to swing said yoke arms about said first axis against the resistance of said biassing means; and said support frame having an upper end, a lower end, a front end and a rear end, and including a seat portion for supporting a user in a first seated position facing the front end of the frame for performing press-type exercises and in a second seated position facing the rear end of the frame for performing pull-type exercises, the first end of the lever arm being pivotally connected to the frame at a location spaced rearwardly from the seat portion and below the seat portion, and the yoke arms being spaced apart by a distance greater than the width of the seat portion whereby said swing arms can project forwardly on opposite sides of said seat portion for gripping by a user in said first seated position to perform press-type exercises.

* * * * *